US006140991A

United States Patent [19]

Miyabe

[11] Patent Number: 6,140,991

[45] Date of Patent: Oct. 31, 2000

[54] LIQUID CRYSTAL DRIVING METHOD AND DRIVING APPARATUS

[75] Inventor: Kosei Miyabe, Tanashi, Japan

[73] Assignee: Citizen Watch Co., Ltd., Tokyo, Japan

[21] Appl. No.: 09/101,730

[22] PCT Filed: May 23, 1997

[86] PCT No.: PCT/JP97/01742

§ 371 Date: Jul. 16, 1998

§ 102(e) Date: Jul. 16, 1998

[51] Int. Cl.[7] ..... G09G 3/36

[52] U.S. Cl. ..... 345/94; 345/87

[58] Field of Search ..... 345/134, 138, 345/204–210, 87–90, 94–97

[56] References Cited

U.S. PATENT DOCUMENTS

| | | | |
|---|---|---|---|
| 4,872,059 | 10/1989 | Shinabe | 358/241 |
| 5,157,387 | 10/1992 | Momose et al. | 340/784 |

FOREIGN PATENT DOCUMENTS

| | | |
|---|---|---|
| 62-183434 | 8/1987 | Japan . |
| 4-180015 | 6/1992 | Japan . |
| 5-173507 | 7/1993 | Japan . |
| 8-241060 | 9/1996 | Japan . |

*Primary Examiner*—Amare Mengistu
*Assistant Examiner*—Jimmy Hai Nguyen
*Attorney, Agent, or Firm*—Finnegan, Henderson, Farabow, Garrett & Dunner, L.L.P.

[57] ABSTRACT

A liquid-crystal display apparatus is provided that achieves a flickerless display while, at the same time, achieving a reduction in crosstalk by reducing the effects of variations in rms voltage. A drive waveform in a period that determines the gray scale of liquid crystal display is produced with a front-edge drive waveform having an edge at its front end or a back-edge drive waveform having an edge at its back end, and the drive waveform is switched between the front-edge drive waveform and the back-edge drive waveform alternately for every n horizontal scanning signals (where n is a positive integer).

8 Claims, 17 Drawing Sheets

TN-LC

STN-LC

LIQUID CRYSTAL DRIVING METHOD AND DRIVING APPARATUS

TECHNICAL FIELD

The present invention relates to a liquid crystal driving method and driving apparatus for displaying an image on a matrix-addressed liquid-crystal panel.

BACKGROUND ART

In a conventional liquid-crystal display apparatus, in the case of a passive matrix liquid-crystal panel whose pixels do not have active elements, an image having intermediate gray shades such as a television image is displayed using a voltage averaging method.

However, using conventional liquid-crystal drive voltage waveforms entails the problem that crosstalk occurs on the display screen. The reason for this will be described below.

In the conventional matrix-addressed liquid-crystal display panel utilizing the voltage averaging method, N data electrodes S and M scanning electrodes T are arranged in a matrix form, each pixel being located at an intersection between the data electrodes S and the scanning electrodes T; the drive voltage waveform applied to each pixel corresponds to the difference between the drive voltage waveform applied to its associated scanning electrode T and the drive voltage waveform applied to its associated data electrode S.

When the matrix-addressed liquid-crystal display panel is driven to display a gray scale, noise is induced in the drive voltage waveform of the scanning electrode T at the rising and falling of the drive voltage waveform of the data electrode S because of the capacitive coupling between the scanning electrode T and the data electrode S. Since this noise is superimposed in such a manner as to reduce or increase the pulse in the drive voltage waveform applied to the pixel, the rms (root-mean-square value) voltage of the voltage waveform becomes smaller or larger than the ideal rms voltage.

The variation of the rms voltage value of the voltage waveform influences the occurrence of crosstalk. However, in the conventional matrix-addressed liquid-crystal panel, the rms voltage of the voltage waveform deviates in the increasing or decreasing direction with respect to the ideal rms voltage and, when these deviations are added up, excessive crosstalk occurs. In particular, in the case of liquid crystal operating in the STN mode, the influence that the variation of the rms voltage has on the occurrence of crosstalk is greater than in the case of TN mode liquid crystal.

To reduce such crosstalk, an improved driving method was proposed in Japanese Patent Unexamined Publication No. 62-183434. In the proposed driving method, fields where the rms voltage of the drive voltages applied to the liquid crystal during the non-selection period becomes smaller than the ideal rms voltage and fields where the rms voltage becomes larger than the ideal rms voltage are repeated in alternate fashion for every predetermined number of fields, thereby bringing the rms voltage of the voltage waveform as a whole closer to the ideal rms voltage.

However, in the liquid-crystal panel driven by such a drive voltage waveform, the rms voltage of the voltage waveform varies from one field to the next and a cycle of the large and small rms voltages is formed, the cycle thus becoming long and resulting in flicker on a screen.

DISCLOSURE OF THE INVENTION

Accordingly, an object of the present invention is to provide a liquid crystal driving method and driving apparatus that achieve a flickerless display while, at the same time, achieving a reduction in crosstalk by reducing the effects of variations in rms voltage.

According to the present invention, in a matrix-addressed liquid-crystal panel that displays gray scale using a voltage averaging method, a drive voltage waveform applied to a pixel during a period that determines the gray scale of liquid crystal display is a front-edge drive waveform having an edge at its front end or a back-edge drive waveform having an edge at its back end, and the drive voltage waveform is switched between the front-edge drive waveform and the back-edge drive waveform alternately for every n horizontal scanning signals (where n is a positive integer), thereby reducing the effects of variations in rms voltage.

EFFECT OF THE INVENTION

In the present invention, since the drive voltage waveform is switched between the front-edge drive waveform and the back-edge drive waveform alternately for every n horizontal scanning signals (where n is a positive integer), as described above, the variation of the rms voltage is offset, reducing the effects of its variation. As a result, crosstalk in the voltage averaging method that would occur due to the accumulation of deviations from the ideal rms voltage can be suppressed.

DETAILED DESCRIPTION OF THE INVENTION

Before describing the embodiments of the present invention, the prior art will be described with reference to the drawings.

Figure 1:
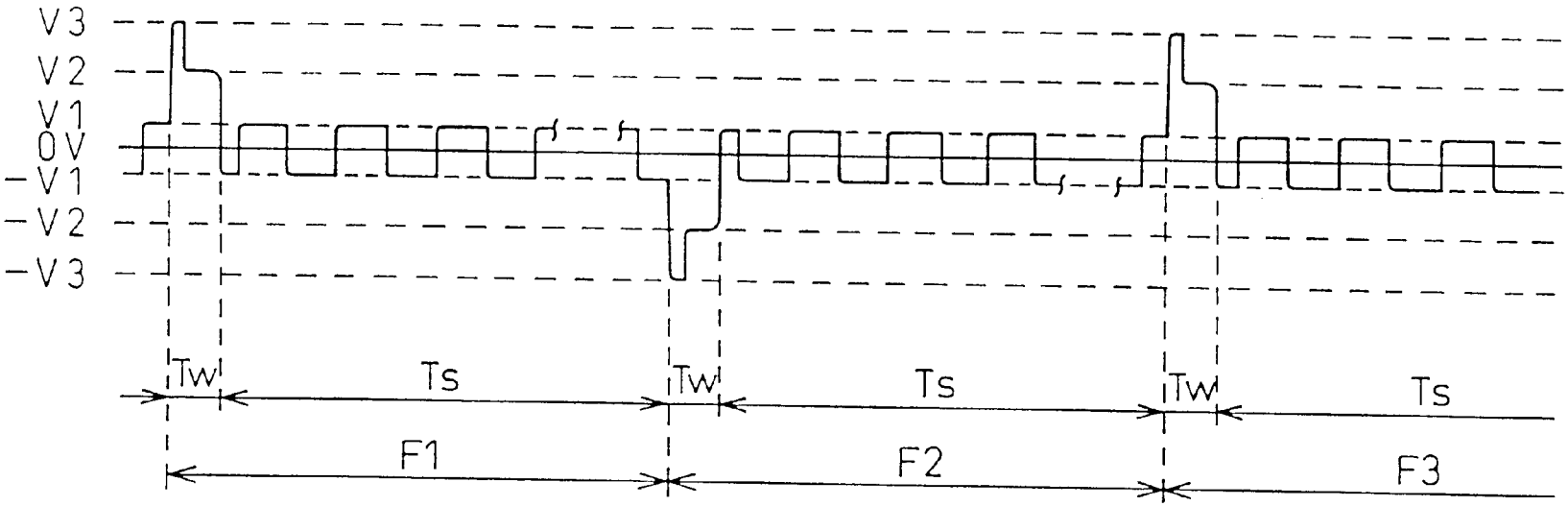
Fig. 1 PRIOR ART
FIG. 1 is a diagram showing a conventional liquid-crystal drive voltage waveform.

FIG. 1 is a waveform diagram showing an example of a drive voltage waveform according to a conventional voltage averaging method. In FIG. 1, during each scan interval, a constant bias voltage waveform having a voltage amplitude of ±V1 is applied during the non-selection period Ts, and a waveform having voltage values of ±V2 and ±V3 is applied during the selection period Tw, gray scale being displayed in accordance with the ratio in time of the voltage value of ±V2 to the voltage value of ±V3 during the selection period. F1, F2 and F3 denote the first, second, and third fields, respectively. Also, shown here is the case where polarity reversion takes place between each field.

However, using the conventional liquid crystal drive voltage waveform shown in FIG. 1 has had the problem that crosstalk occurs on the display screen. The reason for this will be described below.

Figure 2:
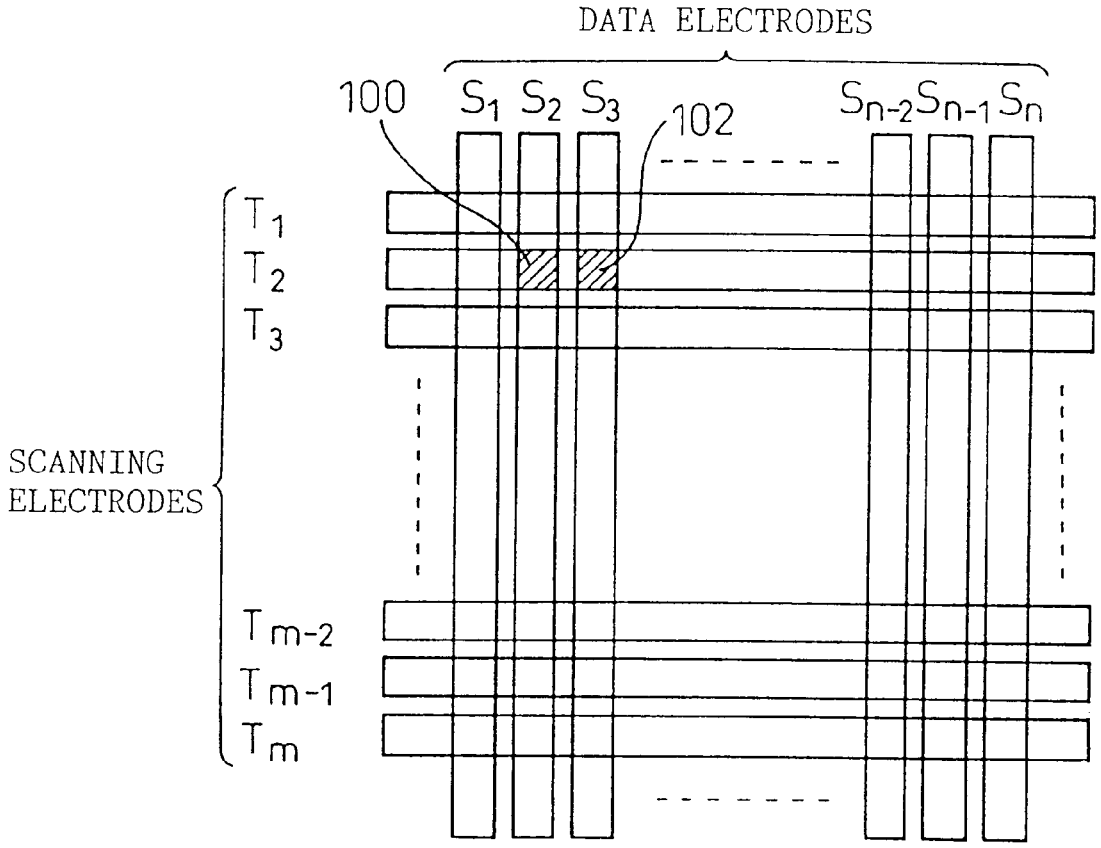
Fig. 2 PRIOR ART
FIG. 2 is a diagram showing an electrode arrangement in a panel of a matrix-addressed liquid-crystal display apparatus.

FIG. 2 shows the electrode arrangement in a matrix-addressed liquid-crystal display panel using the voltage averaging method; the matrix-addressed liquid-crystal display panel has N data electrodes, S1 to Sn, and M scanning electrodes, T1 to Tm, which are arranged in a matrix form.

Pixels indicated at 100 and 102 in FIG. 2 are located where the data electrodes S2 and S3 intersect with the scanning electrode T2, and the drive voltage waveforms applied to these pixels correspond to the difference between the drive voltage waveform of the scanning electrode T2 and that of the data electrode S2 and the difference between the drive voltage waveform of the scanning electrode T2 and that of the data electrode S3, respectively.

Figure 3:
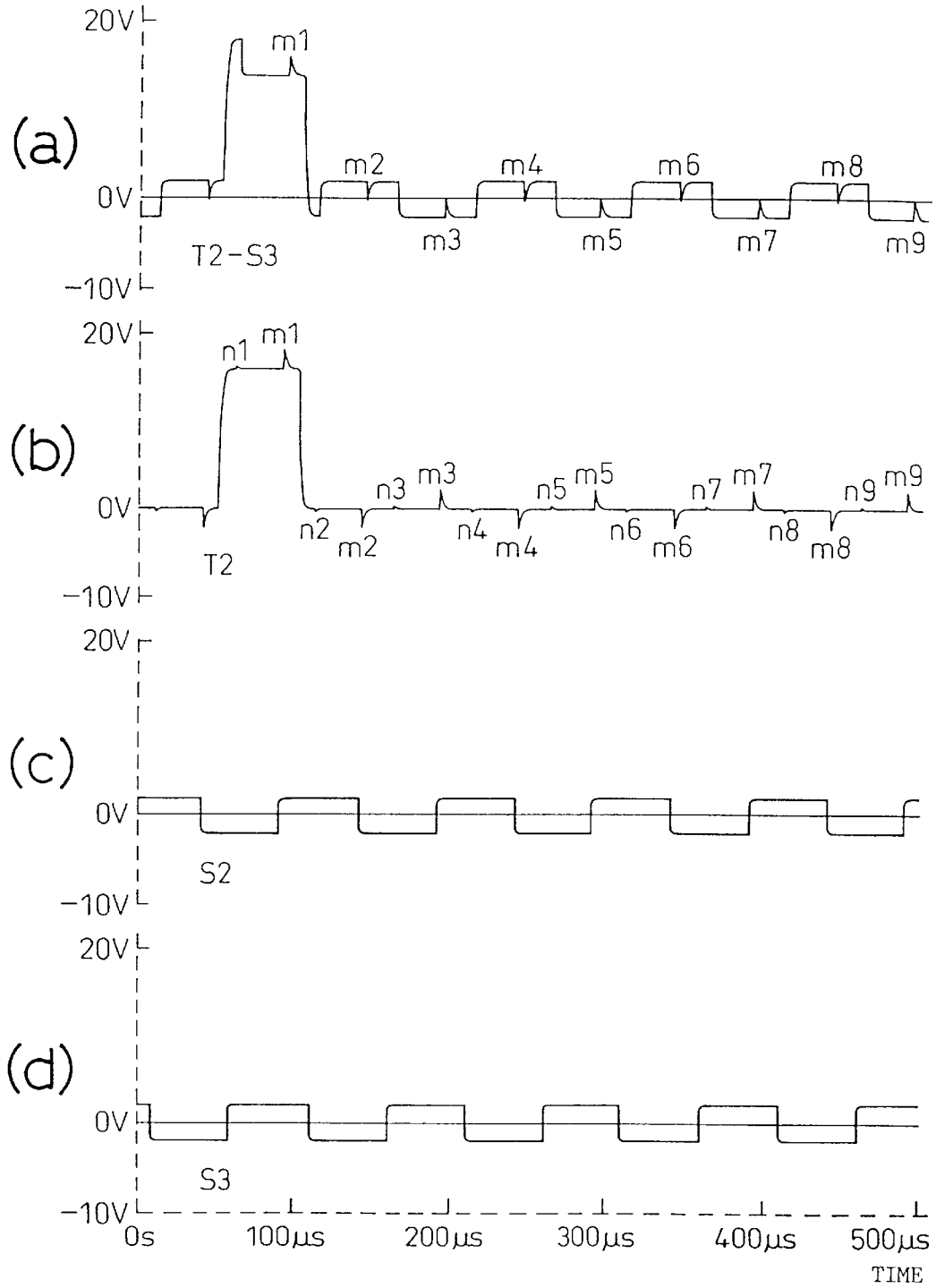
Fig. 3 PRIOR ART
FIG. 3 is a diagram showing the details of the conventional liquid-crystal drive voltage waveform and the drive voltage waveforms that are applied to a scanning electrode T and data electrode S in the matrix-addressed liquid-crystal panel and used to produce the liquid-crystal drive voltage waveform.

FIG. 3 shows the drive voltage waveform applied to the pixel 102 in the matrix-addressed liquid-crystal panel of FIG. 2 during F1 shown in FIG. 1; shown here is a front-edge drive waveform in which the selection pulse applied during the selection period Tw that determines gray scale has a front edge. In FIG. 3, part (b) shows the drive voltage waveform of the scanning electrode T2, part (c) the drive voltage waveform of the data electrode S2, part (d) the drive voltage waveform of the data electrode S3, and part (a) a voltage waveform corresponding to the difference between the drive voltage waveform of the scanning electrode T2 (b) and that of the data electrode S3 (d), that is, the drive voltage waveform (T2−S3) that is applied to the pixel 102.

The voltage waveforms shown in FIG. 3 represent the voltage waveforms, for example, when the matrix-addressed liquid-crystal panel of FIG. 2 is driven to produce a 16-gray scale display, with the pixel 100 displaying gray scale 12 and the pixel 102 gray scale 4, and when the liquid crystal is driven under the condition in which the majority of pixels in the panel are displaying gray scale 12. Accordingly, as shown in FIG. 3, increased current flows in the drive voltage waveform of the scanning electrode T2 (b) synchronously with the timing of the data waveform of gray scale 12 (the drive voltage waveform of the data electrode S2), so that noise components (hereinafter called spikes), m1, m2, . . . , are introduced in the drive voltage waveform of T2 synchronously with the rising and falling of the drive voltage waveform of S2, as shown in FIG. 3(*b*), because of the capacitive coupling between the scanning electrode T2 and the data electrodes S1 to Sn.

Figure 4:
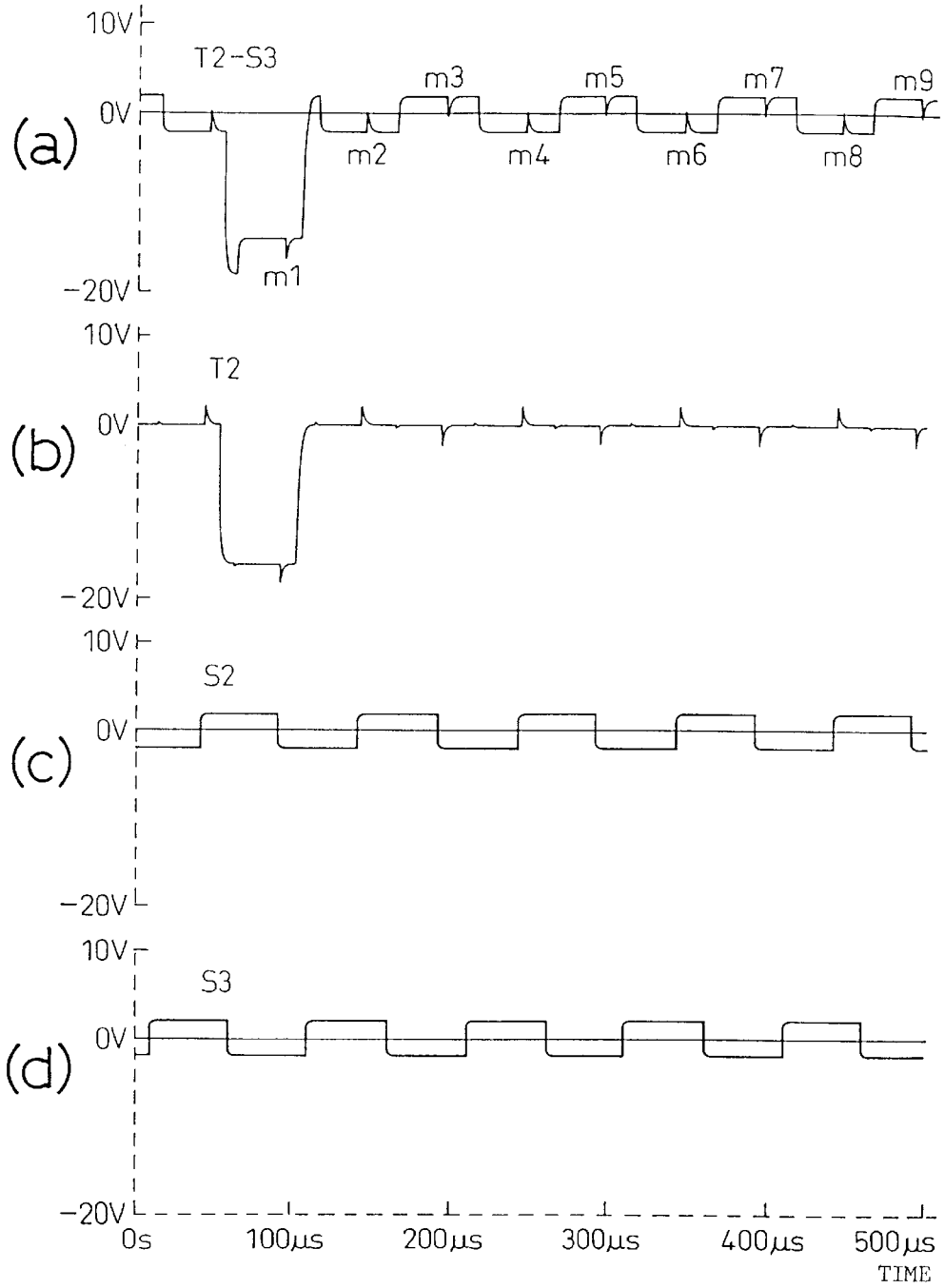
Fig. 4 PRIOR ART
FIG. 4 is a diagram showing the details of the conventional liquid-crystal drive voltage waveform and the drive voltage waveforms that are applied to the scanning electrode T and data electrode S in the matrix-addressed liquid-crystal panel and used to produce the liquid-crystal drive voltage waveform.
Figure 5:
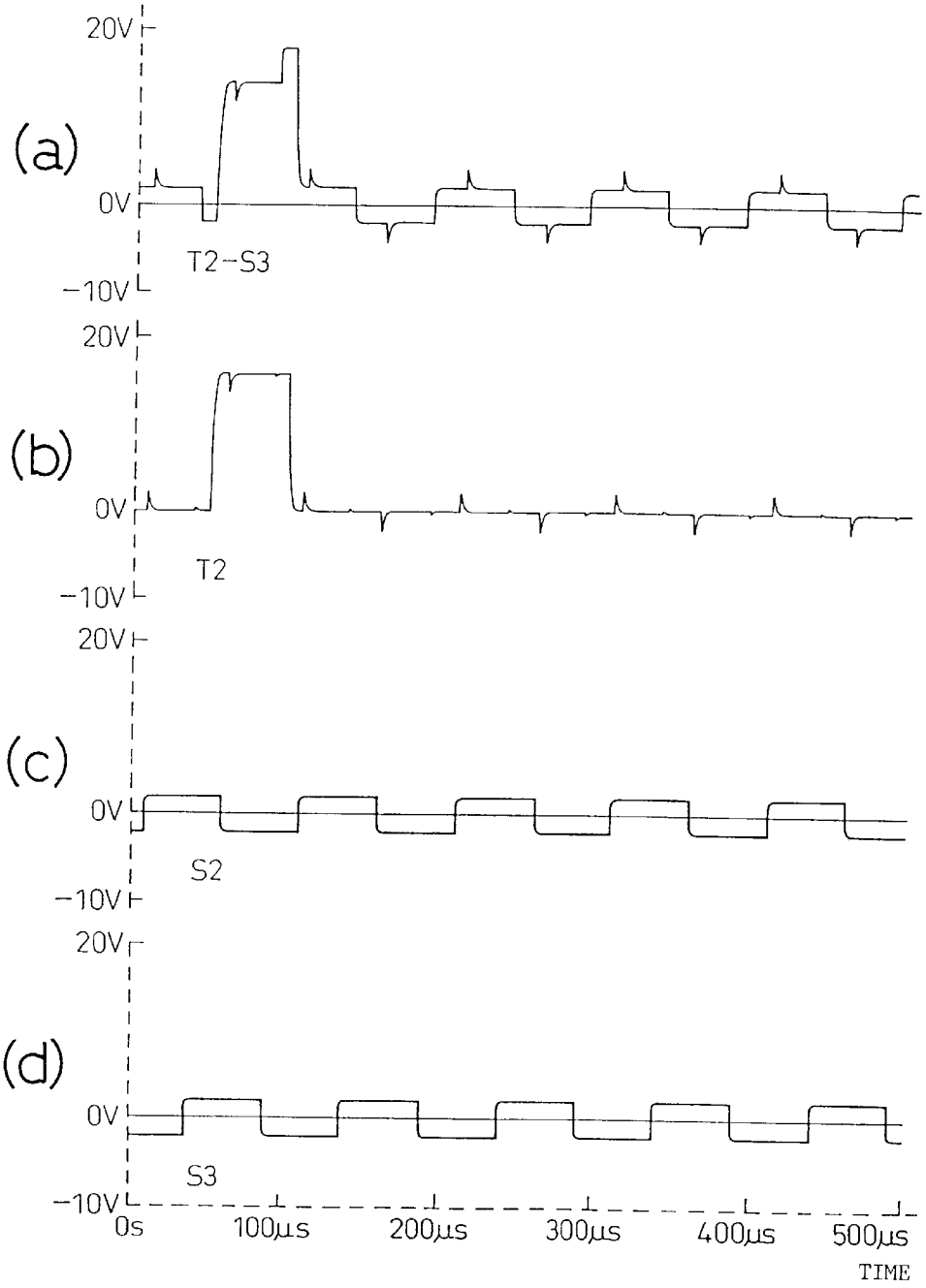
Fig. 5 PRIOR ART
FIG. 5 is a diagram showing the details of the conventional liquid-crystal drive voltage waveform and the drive voltage waveforms that are applied to the scanning electrode T and data electrode S in the matrix-addressed liquid-crystal panel and used to produce the liquid-crystal drive voltage waveform.
Figure 6:
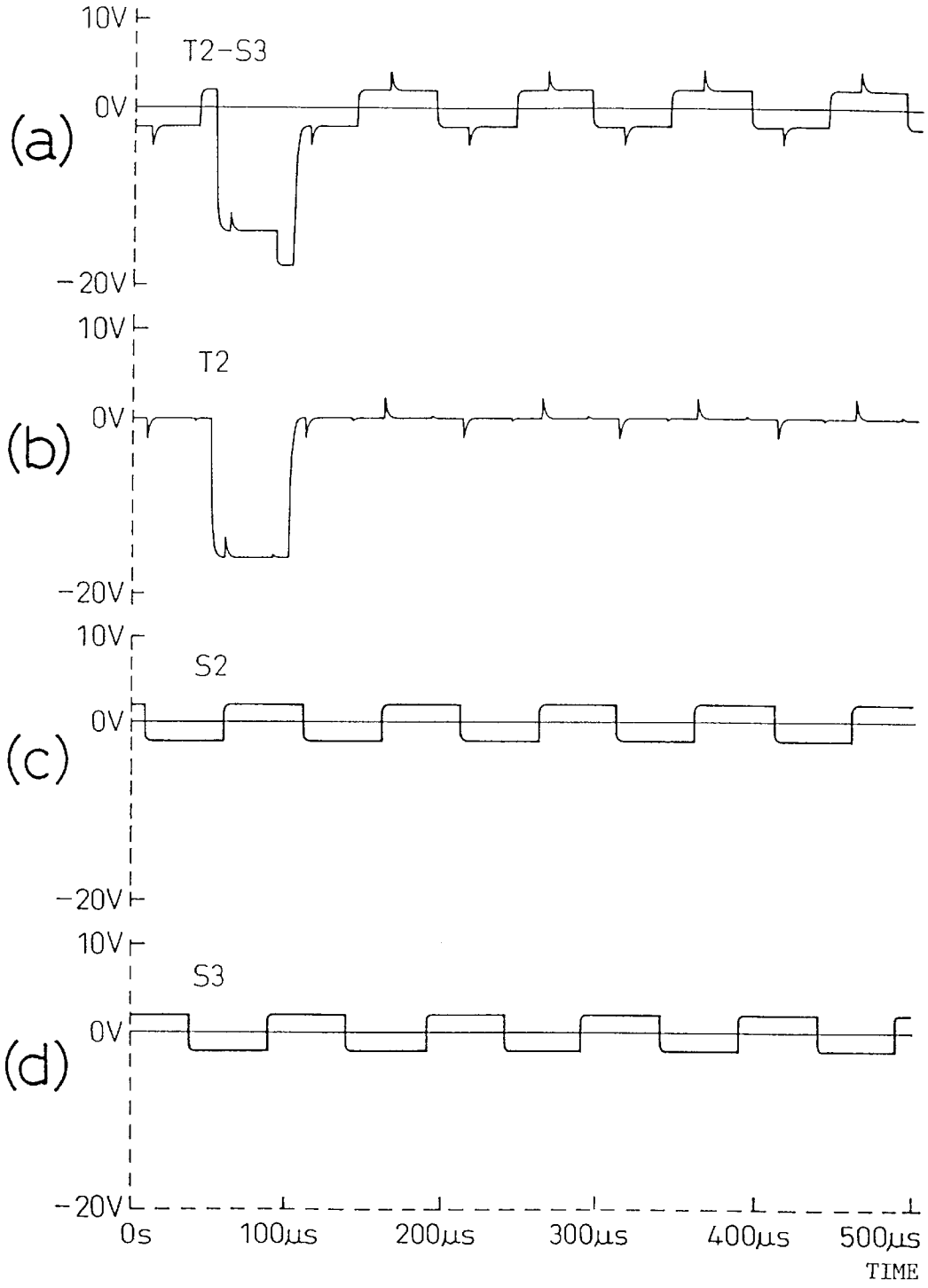
Fig. 6 PRIOR ART
FIG. 6 is a diagram showing the details of the conventional liquid-crystal drive voltage waveform and the drive voltage waveforms that are applied to the scanning electrode T and data electrode S in the matrix-addressed liquid-crystal panel and used to produce the liquid-crystal drive voltage waveform.

On the other hand, in FIG. 3, since the timing current associated with the data waveform of gray scale 4 (the drive voltage waveform of the data electrode S3) is small, the spikes n1, n2, . . . , induced by the capacitive coupling between the scanning electrode T2 and the data electrodes S1 to Sn in this case are significantly small and can be disregarded. FIGS. 4, 5, and 6, explained later, also show drive voltage waveforms under the same condition as in FIG. 3.

In liquid crystal driving, to prevent an ill effect on the liquid crystal, the polarity of the drive voltage is reversed for each field (or for every multiple fields); as shown in FIG. 1, when the polarity is positive in field 1 (F1), the polarity is negative in field 2 (F2), the polarity of the drive voltage being reversed between each field. As can be seen from FIG. 1, the polarity is simply reversed between F1 and F2, and the same waveforms as those in F1 and F2 are repeated in F3 and later fields.

FIG. 4 shows the conventional drive voltage waveform applied to the liquid-crystal panel of FIG. 2 during F2 shown in FIG. 1, illustrating the case in which the selection pulse has a front-edge drive waveform. In FIG. 4, part (b) shows the drive voltage waveform of the scanning electrode T2, part (c) the drive voltage waveform of the data electrode S2, part (d) the drive voltage waveform of the data electrode S3, and part (a) a voltage waveform corresponding to the difference between the drive voltage waveform of the scanning electrode T2 (b) and that of the data electrode S3 (d), that is, the drive voltage waveform (T2–S3) that is applied to the pixel 102. Since the waveform of FIG. 4 is the same as that of FIG. 3 except that the polarity of the drive voltage is reversed from that in F1, a further description will not be given here.

As shown in FIG. 3(*a*), the drive voltage waveform applied to the pixel 102 during F1 in FIG. 1 contains the spikes m1, m2, . . . , induced by interelectrode capacitive coupling, and these spikes act to reduce the pulses; as a result, the rms voltage of the voltage waveform which influences the occurrence of crosstalk becomes smaller than the ideal rms voltage.

Further, as shown in FIG. 4(*a*), the drive voltage waveform applied to the pixel 102 during F2 in FIG. 1 contains the spikes m1, m2, . . . , induced by interelectrode capacitive coupling, and because of these spikes, the rms voltage of the voltage waveform which influences the occurrence of crosstalk becomes smaller than the ideal rms voltage, as in the case of the drive voltage waveform during F1 shown in FIG. 3(*a*).

Conversely, when a drive voltage waveform with a selection pulse having a back edge, i.e., a back-edge drive waveform, such as shown in FIGS. 5(*a*) and 6(*a*), is employed as the drive voltage waveform of FIG. 1, the rms voltage of the drive voltage waveform for the liquid-crystal pixel becomes larger than the ideal rms voltage.

FIGS. 5 and 6 show the drive voltage waveform with the back-edge drive waveform; as in FIGS. 3 and 4, FIGS. 5 and 6 show the drive voltage waveforms applied to the pixel 102 in the liquid-crystal panel of FIG. 2 during F1 and F2, respectively, in FIG. 1. In FIGS. 5 and 6, part (b) shows the drive voltage waveform of the scanning electrode T2, part (c) the drive voltage waveform of the data electrode S2, and part (d) the drive voltage waveform of the data electrode S3. As the case of FIGS. 3 and 4, spikes are induced by the capacitive coupling between the scanning electrode T2 and the data electrodes S1 to Sn. The difference from FIGS. 3 and 4 is that, since the phase relationship between the drive voltage waveform of the scanning electrode T2 (b) and the drive voltage waveform of the data electrode S3 (d) is different, the selection pulse applied to the pixel during the selection period Tw in the voltage waveform (a) has a back-edge drive waveform with the edge at its back end, and the spikes act in such a manner as to add to the pulses.

Crosstalk is influenced by the variation of the rms voltage value of the voltage waveform. In a display apparatus using the drive voltage waveform (front-edge drive waveform) shown in FIGS. 1, 3, and 4, the rms of the drive voltage waveform deviates in the decreasing direction with respect to the ideal rms voltage, while in a display apparatus using the drive voltage waveform (back-edge drive waveform) shown in FIGS. 5 and 6, the rms of the drive voltage waveform deviates in the increasing direction with respect to the ideal rms voltage; with these deviations added up, excessive crosstalk occurs. In particular, in the case of liquid crystal operating in the STN mode, the influence that the variation of the rms voltage has on the occurrence of crosstalk is greater than in the case of TN mode liquid crystal because the contrast is higher in the STN mode liquid crystal.

Figure 7B:
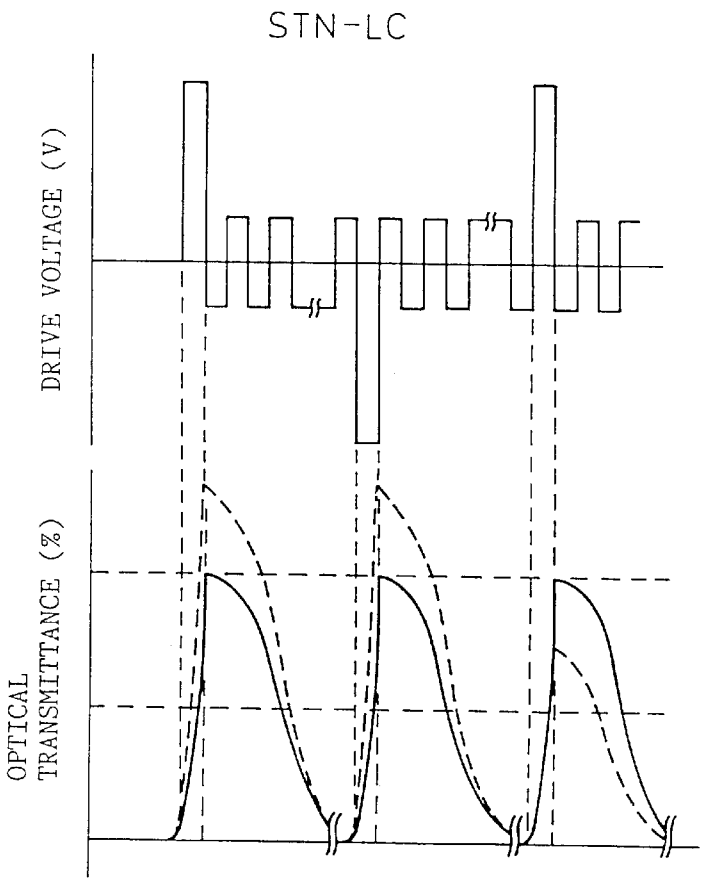
Fig. 7B PRIOR ART
FIG. 7 is a diagram showing the effects of variations in rms voltage.
Figure 7A:
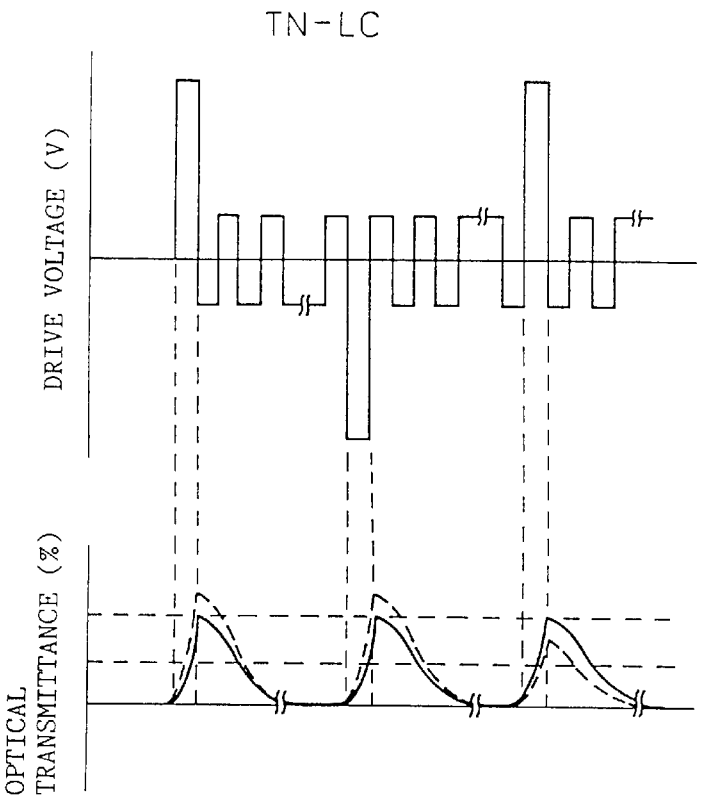
Fig. 7A PRIOR ART

FIGS. 7A and 7B each show the drive voltage waveform applied to the liquid crystal and the corresponding optical transmittance of the liquid crystal, illustrating how the variation of the rms voltage value affects the optical transmittance. FIG. 7A shows the case of TN mode liquid crystal, and FIG. 7B shows the case of STN mode liquid crystal. In the figures, solid lines show the variation of the optical transmittance with the drive voltage, and dashed lines show the variation of the optical transmittance when the rms voltage of the drive voltage increases and decreases. As can be seen from FIGS. 7A and 7B, when the two are compared, the STN mode liquid crystal is more susceptible to the effects of the variation of the rms voltage than the TN mode liquid crystal is. (Refer to "Proceedings of the SID," Vol. 32/4, 1991, pp. 345–350)

Figure 8A:
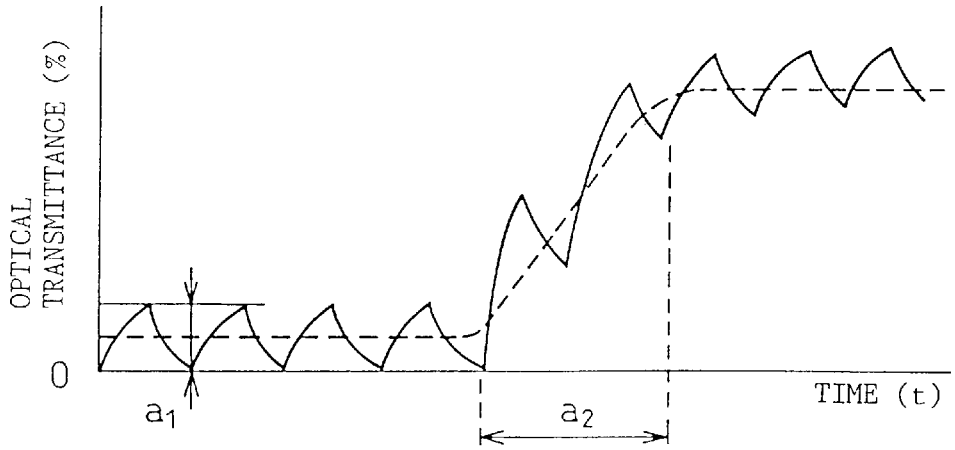
Fig. 8A PRIOR ART
FIG. 8 is a diagram likewise showing the effects of variations in rms voltage.
Figure 8B:
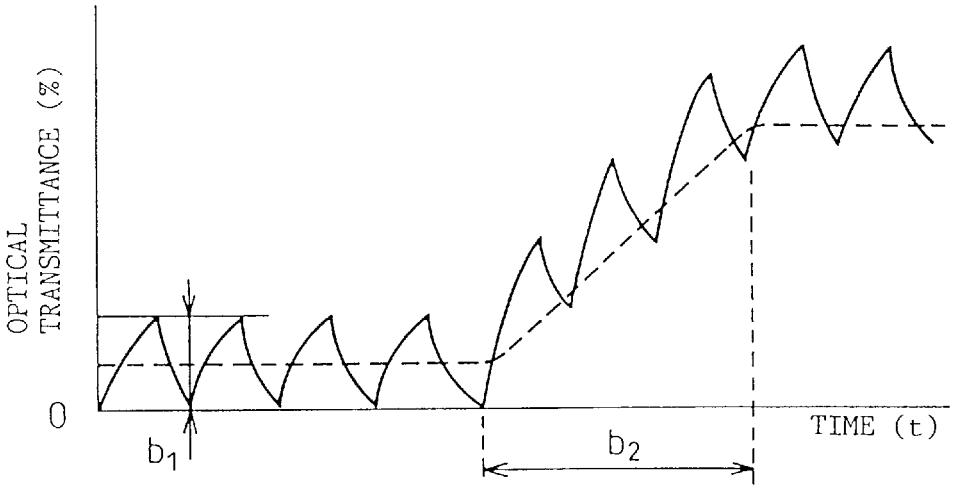
Fig. 8B PRIOR ART

FIGS. 8A and 8B are diagrams showing the relationship between the waveform response of the optical transmittance to the applied voltage and the response time: FIG. 8A shows the case of TN mode liquid crystal, and FIG. 8B shows the case of STN mode liquid crystal. In FIGS. 8A and 8B, a1 and b1 are waveform responses of the TN liquid crystal and the STN liquid crystal, respectively, and a2 and b2 are the response times of the TN liquid crystal and the STN liquid crystal, respectively. The response time is shorter in the TN mode liquid crystal; on the other hand, the waveform response is larger in the STN mode liquid crystal, which is therefore more susceptible to the effects of the variation of the rms voltage, as already shown in FIG. 7B.

Figure 9:
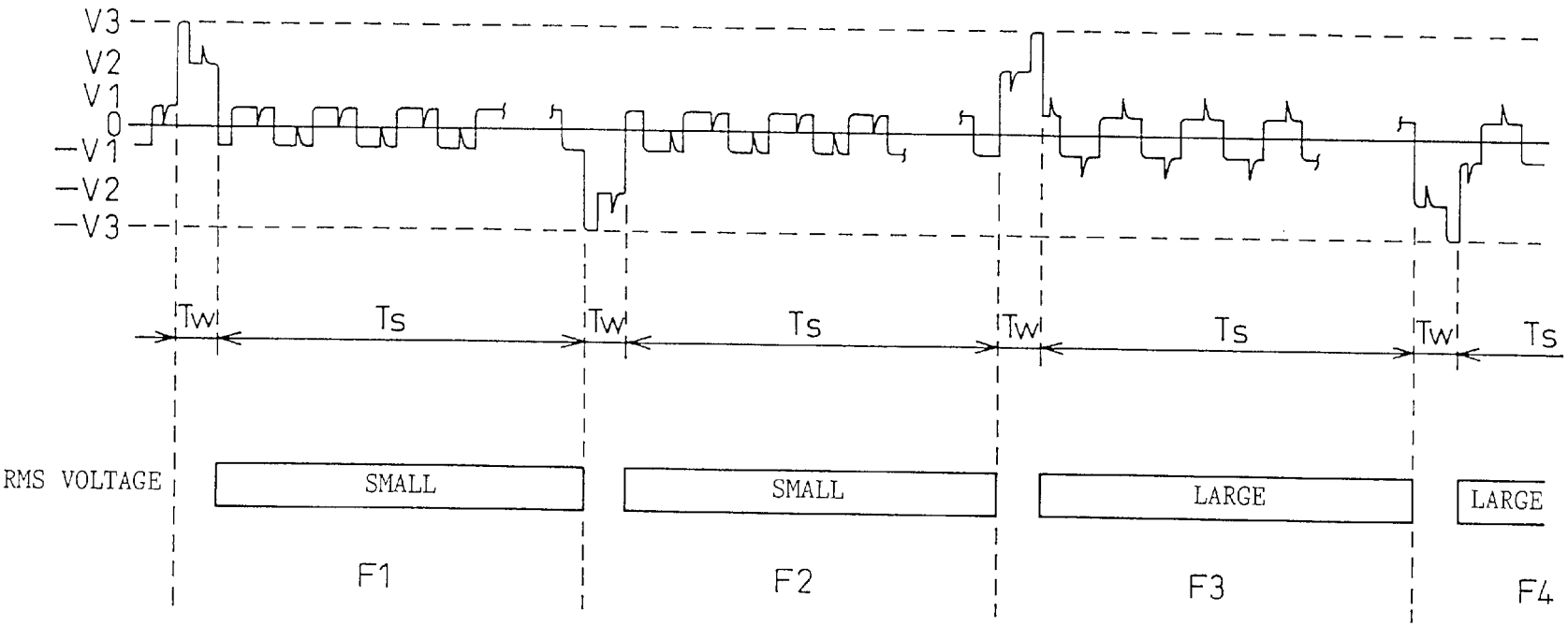
Fig. 9 PRIOR ART
FIG. 9 is a diagram showing an improved conventional liquid-crystal drive voltage waveform.

To reduce such crosstalk, an improved driving method was proposed in Japanese Patent Unexamined Publication No. 62-183434. FIG. 9 shows the drive voltage waveform applied to the pixel 102 in accordance with the proposed driving method.

In the case of the drive voltage waveform shown in FIG. 1, when the waveform of the selection pulse, i.e., the voltage waveform during the selection period Tw, is the front-edge drive waveform, as previously shown, the rms voltage of the drive voltage waveform applied to the pixel 102, i.e., the voltage waveform corresponding to the difference between the drive voltage waveform of the electrode T2 and that of the data electrode S3, becomes smaller than the ideal rms voltage because of the spikes induced by the interelectrode capacitive coupling, as already explained with reference to FIGS. 3 and 4. On the other hand, in the case of the voltage waveform (back-edge drive waveform) shown in FIGS. 5 and 6, the rms voltage of the voltage waveform becomes larger, likewise because of the spikes.

In the driving method shown in FIG. 9, fields where the rms voltage of the drive voltages applied to the liquid crystal during the non-selection period becomes smaller than the ideal rms voltage and fields where the rms voltage becomes larger than the ideal rms voltage are repeated alternately for every predetermined number of fields, attempting to bring the rms voltage of the voltage waveform as a whole closer to the ideal rms voltage.

FIG. 9 shows the drive voltage waveform applied to the pixel 102. As shown in FIG. 9, the drive voltage waveform in each of F1 and F2 is the front-edge drive waveform with the edge at the front end of the pulse, so that the rms voltage becomes smaller as shown in FIGS. 3(*a*) and 4(*a*). On the other hand, the drive voltage waveform in each of F3 and F4 is the back-edge drive waveform with the edge at the back end of the pulse, so that the rms voltage becomes larger as shown in FIGS. 5(*a*) and 6(*a*). Accordingly, the rms voltage as a whole approaches the ideal rms voltage.

When the drive voltage waveform shown in FIG. 9 is applied to the liquid-crystal pixel, the rms voltage varies within each field, but the rms voltage as a whole approaches the ideal rms voltage and the crosstalk is thus reduced.

A discussion of the case where the liquid crystal panel driven by the drive voltage waveform shown in FIG. 9 is used for television follows. In the NTSC system, television images are sent at a rate of about 60 fields per second (59.94 Hz) (50 Hz in PAL or SECAM), one field being about 16 ms long. In terms of the magnitude of the rms voltage during the non-selection period Ts in the drive voltage waveform shown in FIG. 9, F1 is small, F2 is small, F3 is large, and F4 is large, the same pattern being repeated thereafter. In this case, the four fields, i.e., the small, small, large, and large fields, form a large/small cycle which is 64 ms long (15 Hz). As a result, the large/small cycle of the rms voltage becomes long, resulting in image flicker.

Figure 10:
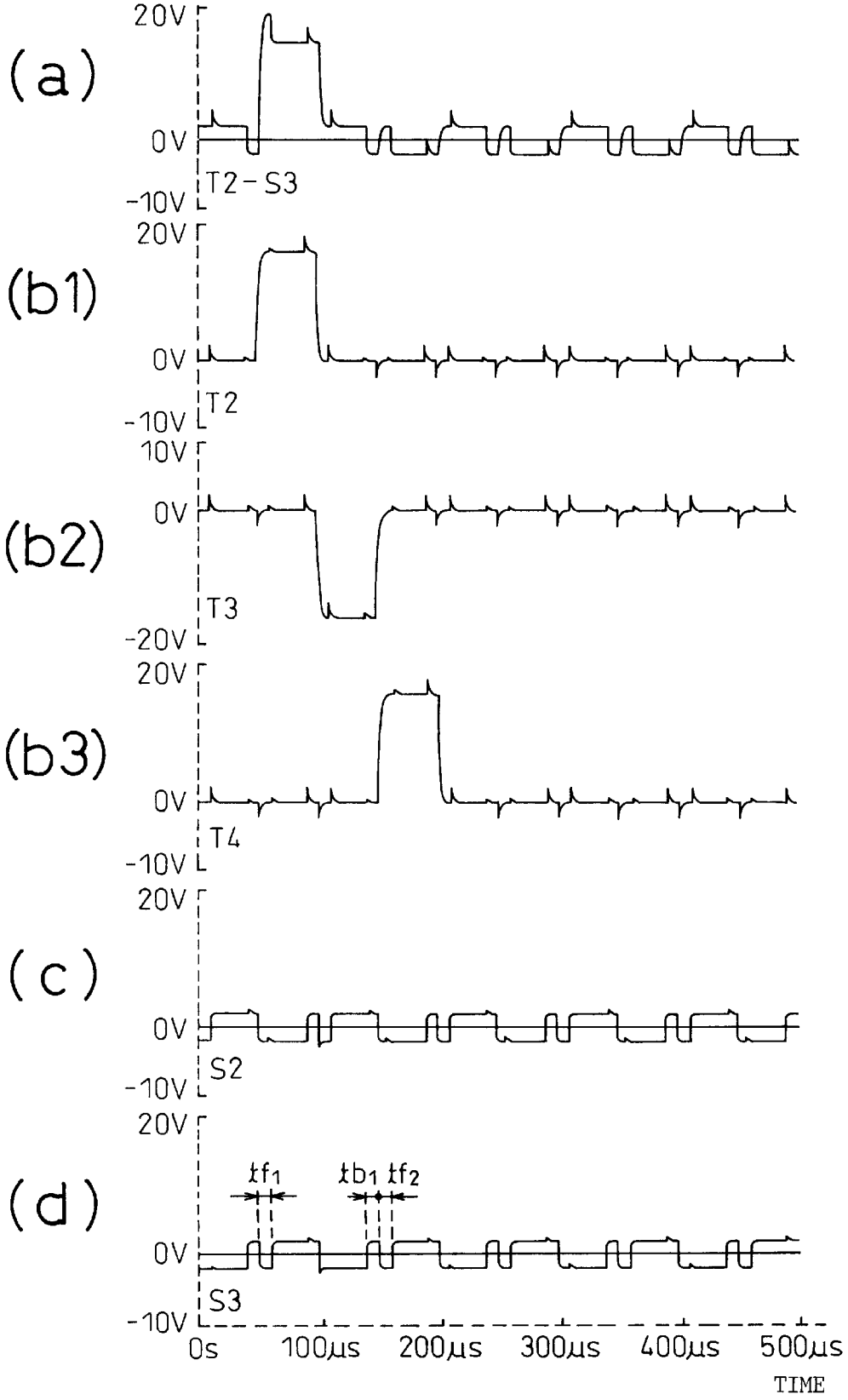
FIG. 10 is a diagram showing an embodiment of a liquid-crystal drive voltage waveform according to the present invention.

FIG. 10 shows an embodiment of a liquid crystal drive voltage waveform according to the present invention. FIG. 10 shows the drive voltage waveforms of the scanning electrodes T and data electrodes S in the matrix-addressed liquid-crystal panel of FIG. 2, and the drive voltage waveform that is produced from the scanning electrode drive voltage waveform and data electrode drive voltage waveform and applied to the liquid-crystal pixel. The voltage waveforms shown in FIG. 10, like the voltage waveforms shown in FIG. 3, represent the voltage waveforms when the matrix-addressed liquid-crystal panel of FIG. 2 is driven to produce a 16-gray scale display, with the pixel 100 displaying gray scale 12 and the pixel 102 gray scale 4, and when the liquid crystal is driven under the condition in which the majority of pixels in the matrix-addressed liquid-crystal panel are displaying gray scale 12.

In FIG. 10, parts (b1), (b2), and (b3) show the drive voltage waveforms sequentially applied to the scanning electrodes T2, T3, and T4, respectively, part (c) the drive voltage waveform applied to the data electrode S2, (d) the drive voltage waveform applied to the data electrode S3, and (a) the drive voltage waveform applied to the pixel 102 in FIG. 2, which voltage waveform corresponds to the difference (T2–S3) between the drive voltage waveform of the scanning electrode T2 (b1) and the drive voltage waveform of the data electrode S3 (d).

In the drive voltage waveforms of FIG. 10, as in the drive voltage waveforms of FIG. 3, increased current flows to the scanning electrodes T2, T3, and T4 synchronously with the timing of the data waveform of gray scale 12 (the drive voltage waveform of the data electrode S2) in the matrix-addressed liquid-crystal panel as a whole. Accordingly, spikes are induced in the drive voltage waveforms (b1), (b2), and (b3) of the scanning electrodes T2, T3, and T4 because of the capacitive coupling between the scanning electrodes T2, T3, and T4 and the data electrodes S1 to Sn. On the other hand, since the timing current associated with the data waveform of gray scale 4 (the drive voltage waveform of the data electrode S3) is small, the spikes induced by the capacitive coupling between the scanning electrodes T2, T3, and T4 and the data electrodes S1 to Sn in this case are significantly small and can be disregarded.

The drive voltage waveform (T2–S3) applied to the pixel 102 of FIG. 2, which is shown as the drive voltage waveform (a), is produced from the drive voltage waveform of the scanning electrode T2 (b1) and the drive voltage waveform of the data electrode S3 (d). Looking at this drive voltage waveform (a), the drive waveform during the period (the selection period Tw—see FIG. 1) that determines the gray scale of liquid crystal display has an edge at its front end (this waveform is hereinafter described as the "front-edge drive waveform", and a waveform having an edge at its back end as the "back-edge drive waveform"). In the subsequent period (the non-selection period Ts—See FIG. 1), the waveform is such that the spikes act to reduce the pulses in some portions and increase the pulses in other portions. Accordingly, in the above drive voltage waveform, since the variation of the rms voltage is offset within one field period, crosstalk does not occur.

Next, referring to FIG. 10, a description will be given of how the drive voltage waveform (a) is produced. The drive voltage waveform (a) corresponds to the difference (T2–S3) between the drive voltage waveform of the scanning electrode T2 (b1) and that of the data electrode S3 (d) in FIG. 10. The drive voltage waveforms (b1), (b2), and (b3) are horizontal scanning signals sequentially applied to the scanning electrodes T2, T3, and T4. The timing of the selection period Tw for these signals is displaced by 1/m from one signal to the next (m is the number of scanning electrodes—the horizontal scanning signals applied to the scanning electrodes T2, T3, and T4 are only shown here, but actually, m horizontal scanning signals are applied, one displaced by 1/m from the next). As seen, spikes are induced in the drive voltage waveforms (b1), (b2), and (b3) because of the current that flows synchronously with the timing of the drive voltage waveform of the data electrode S2. Part (d) shows the drive voltage waveform applied to the data electrode S3; this waveform determines whether the waveform applied during the period (selection period Tw) that determines the gray scale of liquid crystal display is the front-edge drive waveform or the back-edge drive waveform, and also whether the waveform during the subsequent period (non-selection period Ts) is one that offsets the variation of the rms voltage.

In the drive voltage waveform of the data electrode S3 (d), tf indicates the portion of the waveform which causes the waveform in the selection period Tw to become a front-edge drive waveform, and tb the portion of the waveform which causes the waveform in the selection period Tw to become a back-edge drive waveform. For example, from the drive voltage waveform of the scanning electrode T2 (b1) and the portion $tf_1$ of the drive voltage waveform of the data electrode S3 (d), the front-edge drive waveform shown in the drive voltage waveform (a) is produced that has an edge at its front end. Likewise, from the drive voltage waveform of the scanning electrode T3 (b2) and the portion $tb_1$ of the drive voltage waveform of the data electrode S3 (d), the back-edge drive waveform having an edge at its back end is produced (which will be described later with reference to FIG. 12). Further, from the drive voltage waveform of the scanning electrode T4 (b3) and the portion $tf_2$ of the drive voltage waveform of the data electrode S3 (d), the front-edge drive waveform having an edge at its front end is produced (which will be described later with reference to FIG. 13). The drive voltage waveforms in the periods subsequent to the front-edge drive waveform and back-edge drive waveform also have the shapes that offsets the variation of the rms voltage, as shown in the drive voltage waveform (a).

Figure 11:
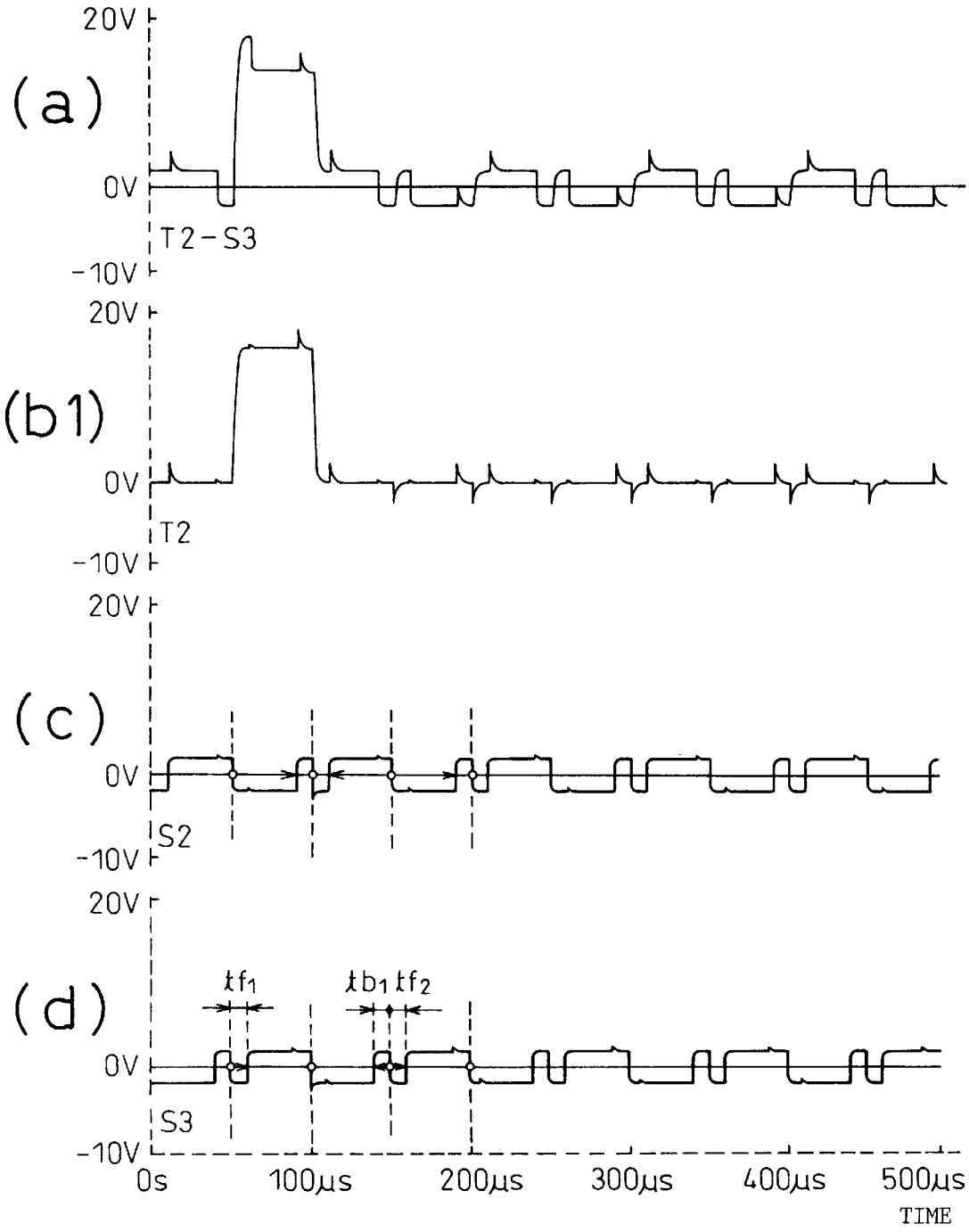
FIG. 11 is a diagram showing the details of the liquid-crystal drive voltage waveform of the present invention shown in FIG. 10 and the drive voltage waveforms that are applied to the scanning electrode T and data electrode S in the matrix-addressed liquid-crystal panel and used to produce the liquid-crystal drive voltage waveform.
Figure 12:
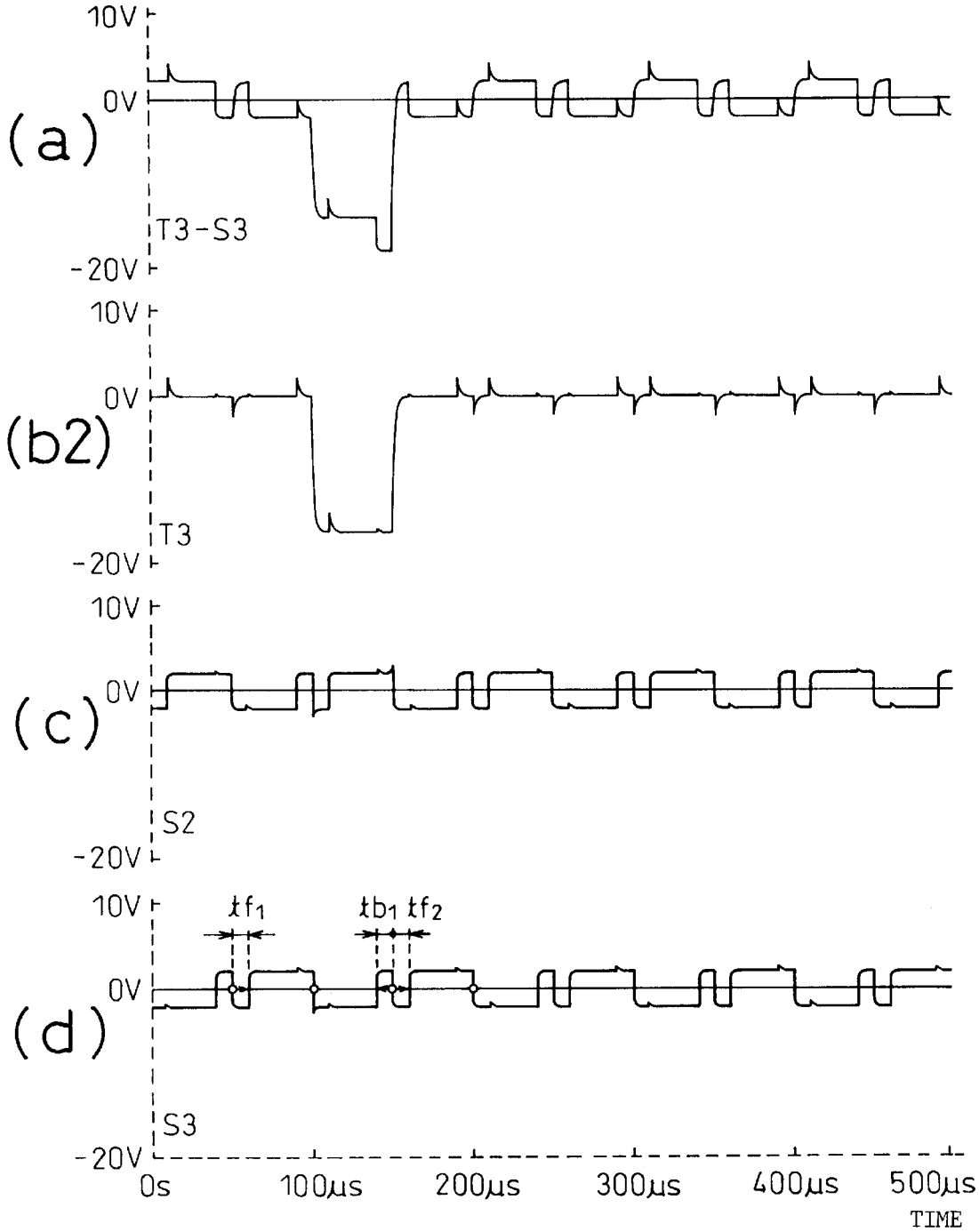
FIG. 12 is a diagram showing the details of the liquid-crystal drive voltage waveform of the present invention shown in FIG. 10 and the drive voltage waveforms that are applied to the scanning electrode T and data electrode S in the matrix-addressed liquid-crystal panel and used to produce the liquid-crystal drive voltage waveform.
Figure 13:
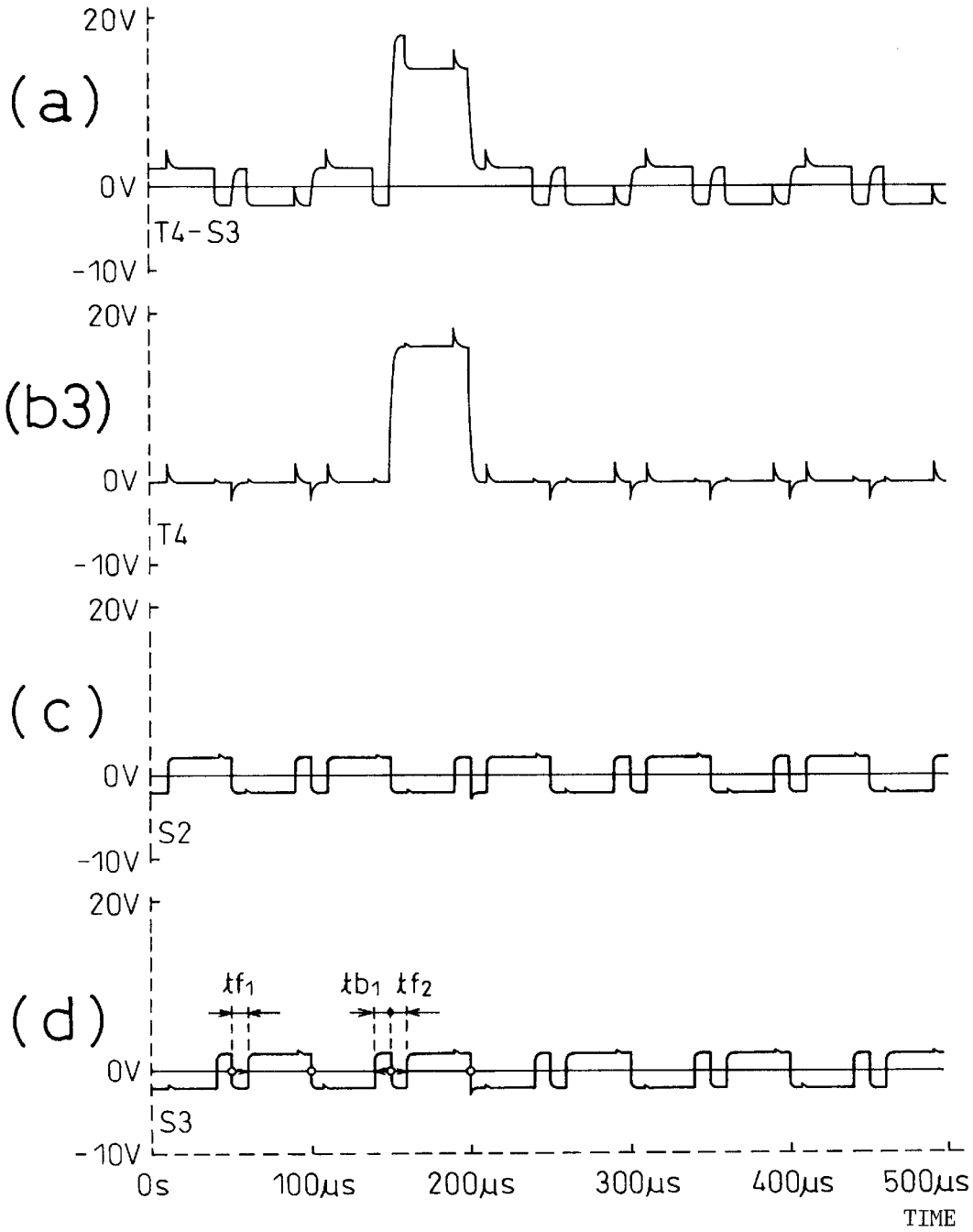
FIG. 13 is a diagram showing the details of the liquid-crystal drive voltage waveform of the present invention shown in FIG. 10, and the drive voltage waveforms that are applied to the scanning electrode T and data electrode S in the matrix-addressed liquid-crystal panel and used to produce the liquid-crystal drive voltage waveform.

FIGS. 11 to 13 show the details of the liquid crystal drive voltage waveform of the present invention shown in FIG. 10, and depict specifically how the front-edge drive waveform and back-edge drive waveform are produced from the scanning electrode drive voltage waveform and data electrode drive voltage waveform. Each figure shows the drive voltage waveforms of the scanning electrode T and data electrodes S in the matrix-addressed liquid-crystal panel of FIG. 2 and the drive voltage waveform that is produced from the scanning electrode drive voltage waveform and data electrode drive voltage waveform and is applied to the liquid-crystal pixel. The voltage waveforms shown in FIG. 11 to 13, like the voltage waveforms shown in FIG. 3, represent the voltage waveforms when the matrix-addressed liquid-crystal panel of FIG. 2 is driven to produce a 16-gray scale display, and when the liquid crystal is driven under the condition in which, in the panel as a whole, increased current flows synchronously with the timing of the data waveform of the gray scale 12 (the drive voltage waveform of the data electrode S2), inducing spikes in the drive voltage waveform applied to the scanning electrode T.

FIG. 11 shows the scanning electrode drive waveform and data electrode drive waveform used to produce the front-edge drive waveform and the phase relationship between the two waveforms.

In FIG. 11, part (b1) shows the drive voltage waveform applied to the scanning electrode T2, (c) the drive voltage waveform applied to the data electrode S2, (d) the drive voltage waveform applied to the data electrode S3, and (a) the drive voltage waveform applied to the pixel 102 (FIG. 2), the waveform corresponding to the difference (T2–S3) between the drive voltage waveform of the scanning electrode T2 (b1) and the drive voltage waveform of the data electrode S3 (d). These waveforms correspond respectively to the scanning electrode drive waveform (b1), the data electrode drive waveform (d), and the drive voltage waveform (a) applied to the pixel 102 (FIG. 2), shown in FIG. 10.

That is, FIG. 11 shows the drive voltage waveform of the scanning electrode T2 (b1), the drive voltage waveform of the data electrode S3 (d), and the front edge drive voltage waveform (a) with the edge at its front end, that is produced from the drive voltage waveform (b1) and drive voltage waveform (d). In this case, the front-edge drive voltage waveform is produced using the portion $tf_1$ of the drive voltage waveform (d).

FIG. 12 shows the scanning electrode drive waveform and data electrode drive waveform used to produce the back-edge drive waveform whose polarity is reversed relative to the pixel drive voltage waveform (a) shown in FIG. 11, and the phase relationship between the two waveforms.

In FIG. 12, part (b2) shows the drive voltage waveform applied to the scanning electrode T3, (c) the drive voltage waveform applied to the data electrode S2, (d) the drive voltage waveform applied to the data electrode S3, and (a) the drive voltage waveform applied to the pixel, the waveform corresponding to the difference (T3–S3) between the drive voltage waveform of the scanning electrode T3 (b2) and the drive voltage waveform of the data electrode S3 (d).

FIG. 12(*a*) shows the back-edge drive voltage waveform with the edge at its back end, that is produced from the drive voltage waveform (b2) and drive voltage waveform (d). In this case, the back edge drive voltage waveform is produced using the portion $tb_1$ of the drive voltage waveform (d).

FIG. 13 shows the scanning electrode drive waveform and data electrode drive waveform used to produce the front-edge drive waveform and the phase relationship between the two waveforms.

In FIG. 13, part (b3) shows the drive voltage waveform applied to the scanning electrode T4, (c) the drive voltage waveform applied to the data electrode S2, (d) the drive voltage waveform applied to the data electrode S3, and (a) the drive voltage waveform applied to the pixel, the waveform corresponding to the difference (T4–S3) between the drive voltage waveform of the scanning electrode T4 (b3) and the drive voltage waveform of the data electrode S3 (d).

FIG. 13(*a*) shows the front-edge drive voltage waveform with the edge at its front end, that is produced from the drive voltage waveform (b3) and drive voltage waveform (d). In this case, the back edge drive voltage waveform is produced using the portion $tf_2$ of the drive voltage waveform (d).

The drive voltage waveform of the present invention shown in FIGS. 10 to 13 is for the case in which the drive voltage waveform is switched between the front-edge drive waveform and the back-edge drive waveform for every scanning signal. The effects of the variation of the rms voltage can also be reduced by switching the drive voltage waveform between the front-edge drive waveform and the back-edge drive waveform alternately for every multiple scanning signals, for example, for every two or three scanning signals or for every n scanning signals.

The formation of the front-edge drive waveform or back-edge drive waveform can be accomplished by adjusting the phase between the scanning electrode drive waveform and the data electrode drive waveform. It can also be accomplished by changing the shape of the data electrode drive waveform. Further, it can be accomplished by adjusting the phase between the scanning electrode drive waveform and the data electrode drive waveform and by changing the shape of the data electrode drive waveform.

Next, the details of a liquid crystal drive voltage waveform according to an alternative embodiment of the present invention will be shown. In this embodiment, the front-edge drive waveform and back-edge drive waveform alternate for every two scanning signals.

FIGS. 14 to 17 show the details of the liquid crystal drive voltage waveform when it is switched between the front-edge drive waveform and the back-edge drive waveform alternately for every two scanning signals, and depict specifically how the front-edge drive waveform and back-edge drive waveform are produced from the scanning electrode drive voltage waveform and data electrode drive voltage waveform. Each figure shows the drive voltage waveforms of the scanning electrode T and data electrodes S in the matrix-addressed liquid-crystal panel of FIG. 2 and the drive voltage waveform that is produced from the scanning electrode drive voltage waveform and data electrode drive voltage waveform and is applied to the liquid-crystal pixel. The voltage waveforms shown in FIG. 14 to 17, like the voltage waveform shown in FIG. 3, represent the voltage waveforms when the matrix-addressed liquid-crystal panel of FIG. 2 is driven to produce a 16-gray scale display, and when the liquid crystal is driven under the condition in which, in the panel as a whole, increased current flows synchronously with the timing of the data waveform of the gray scale 12 (the drive voltage waveform of the data electrode S2), inducing spikes in the drive voltage waveform applied to the scanning electrode T.

Figure 14:
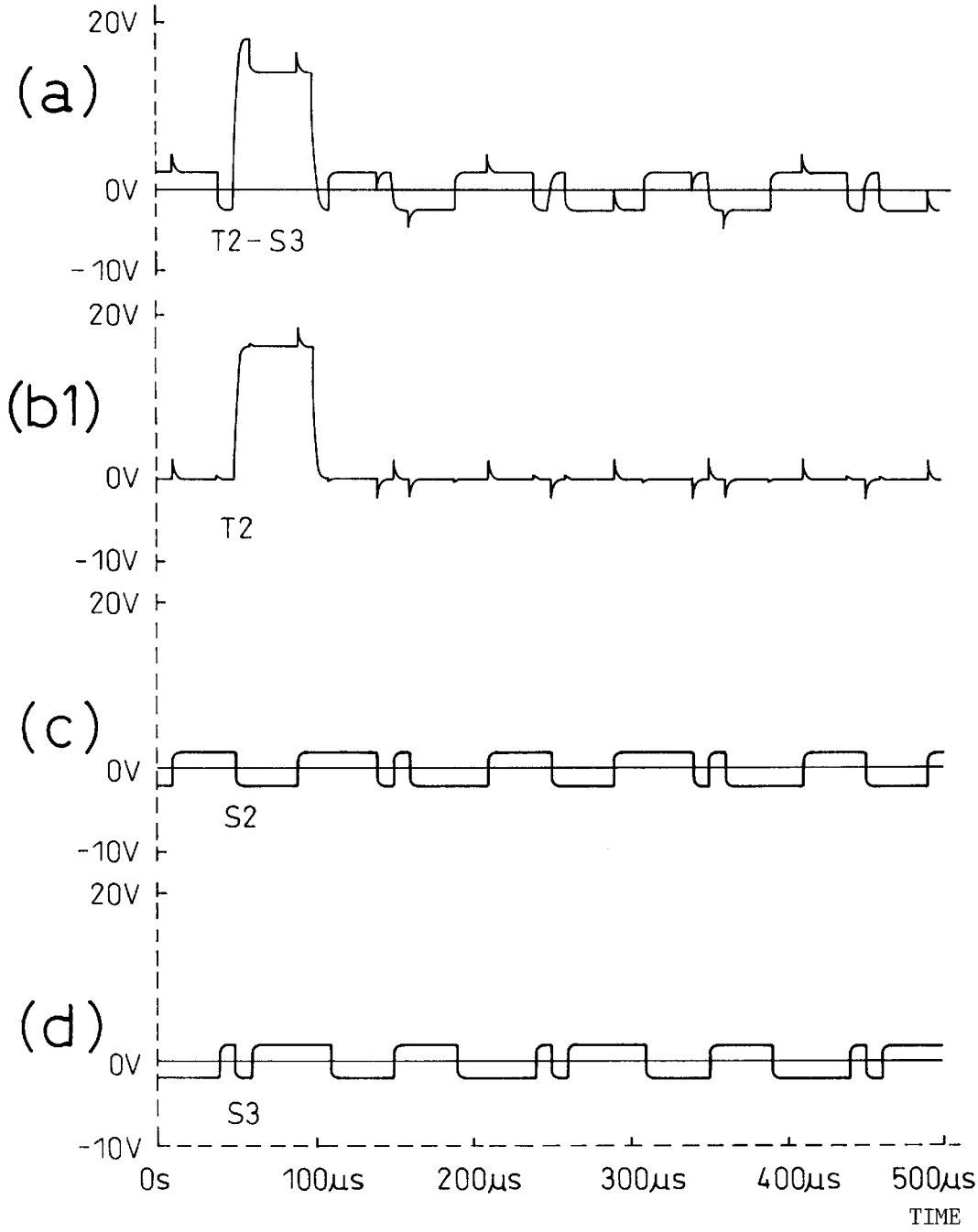
FIG. 14 is a diagram showing the details of the liquid-crystal drive voltage waveform according to an alternative embodiment of the present invention, and the drive voltage waveforms that are applied to the scanning electrode T and data electrode S in the matrix-addressed liquid-crystal panel and used to produce the liquid-crystal drive voltage waveform.

FIG. 14 shows the scanning electrode drive waveform and data electrode drive waveform used to produce the front-edge drive waveform and the phase relationship between the two waveforms.

In FIG. 14, part (b1) shows the drive voltage waveform applied to the scanning electrode T2, (c) the drive voltage waveform applied to the data electrode S2, (d) the drive voltage waveform applied to the data electrode S3, and (a) the drive voltage waveform applied to the pixel 102 (FIG. 2), the waveform corresponding to the difference (T2–S3) between the drive voltage waveform of the scanning electrode T2 (b1) and the drive voltage waveform of the data electrode S3 (d).

Figure 15:
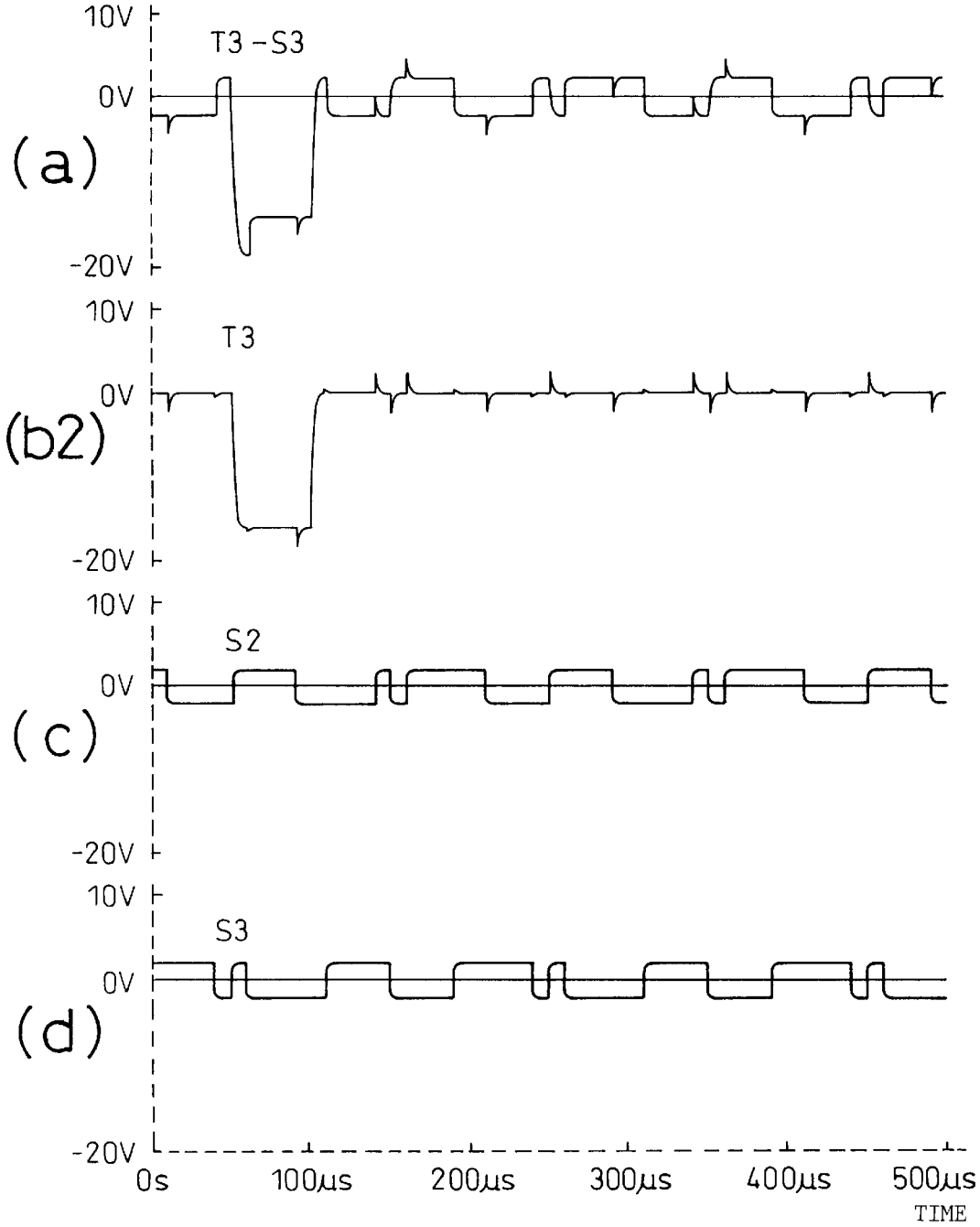
FIG. 15 is a diagram showing the details of the liquid-crystal drive voltage waveform according to the alternative embodiment of the present invention, and the drive voltage waveforms that are applied to the scanning electrode T and data electrode S in the matrix-addressed liquid-crystal panel and used to produce the liquid-crystal drive voltage waveform.

FIG. 15 shows the scanning electrode drive waveform and data electrode drive waveform used to produce the front-edge drive waveform whose polarity is reversed relative to the pixel drive voltage waveform (a) shown in FIG. 14, and the phase relationship between the two waveforms.

In FIG. 15, part (b2) shows the drive voltage waveform applied to the scanning electrode T3, (c) the drive voltage waveform applied to the data electrode S2, (d) the drive voltage waveform applied to the data electrode S3, and (a) the drive voltage waveform applied to the pixel, the waveform corresponding to the difference (T3–S3) between the drive voltage waveform of the scanning electrode T3 (b2) and the drive voltage waveform of the data electrode S3 (d).

Figure 16:
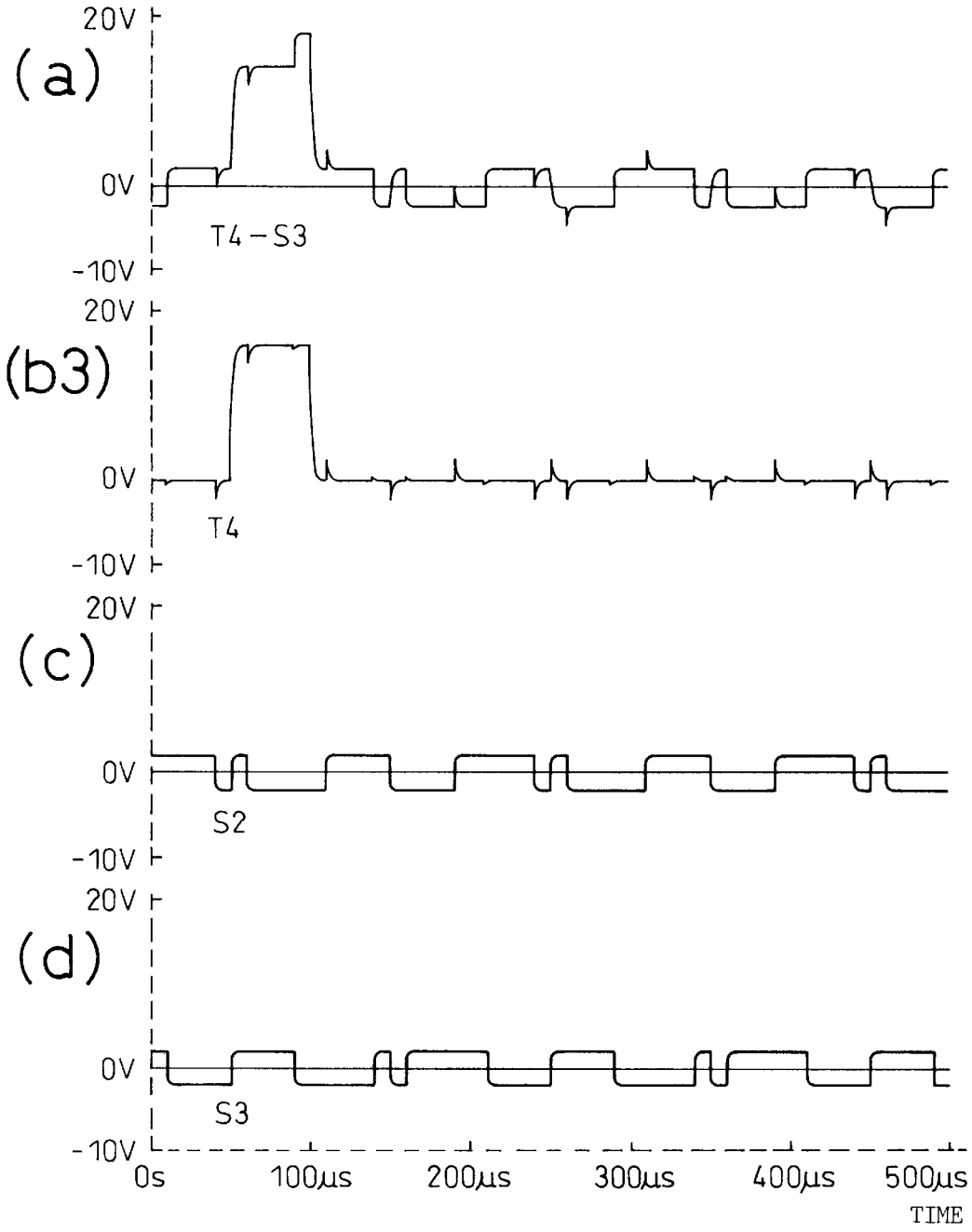
FIG. 16 is a diagram showing the details of the liquid-crystal drive voltage waveform according to the alternative embodiment of the present invention, and the drive voltage waveforms that are applied to the scanning electrode T and data electrode S in the matrix-addressed liquid-crystal panel and used to produce the liquid-crystal drive voltage waveform.

FIG. 16 shows the scanning electrode drive waveform and data electrode drive waveform used to produce the back-edge drive waveform and the phase relationship between the two waveforms.

In FIG. 16, part (b3) shows the drive voltage waveform applied to the scanning electrode T4, (c) the drive voltage waveform applied to the data electrode S2, (d) the drive voltage waveform applied to the data electrode S3, and (a) the drive voltage waveform applied to the pixel, the waveform corresponding to the difference (T4–S3) between the drive voltage waveform of the scanning electrode T4 (b3) and the drive voltage waveform of the data electrode S3 (d).

Figure 17:
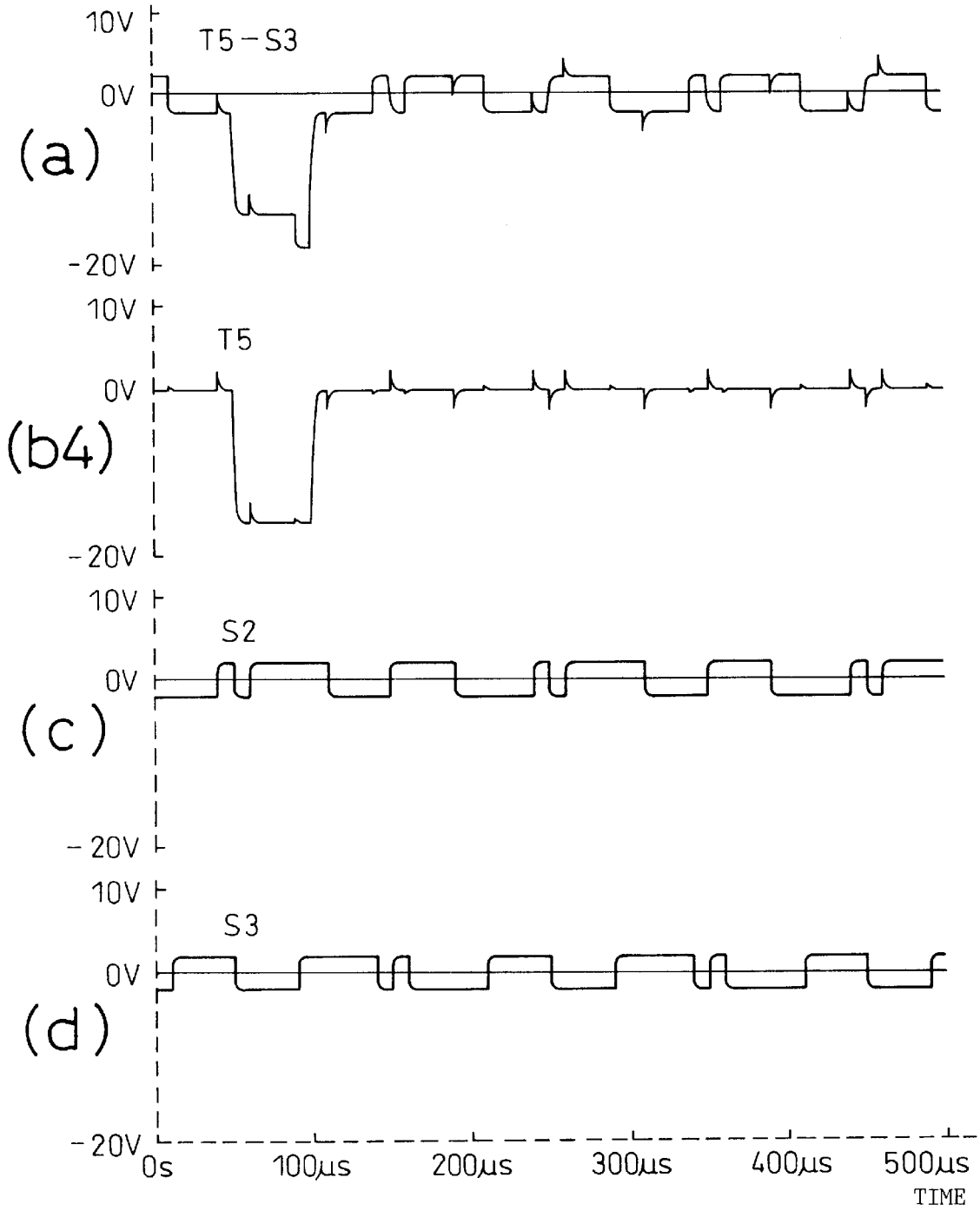
FIG. 17 is a diagram showing the details of the liquid-crystal drive voltage waveform according to the alternative embodiment of the present invention, and the drive voltage waveforms that are applied to the scanning electrode T and data electrode S in the matrix-addressed liquid-crystal panel and used to produce the liquid-crystal drive voltage waveform.

FIG. 17 shows the scanning electrode drive waveform and data electrode drive waveform used to produce the back-edge drive waveform whose polarity is reversed relative to the pixel drive voltage waveform (a) shown in FIG. 16, and the phase relationship between the two waveforms.

In FIG. 17, part (b4) shows the drive voltage waveform applied to the scanning electrode T5, (c) the drive voltage waveform applied to the data electrode S2, (d) the drive voltage waveform applied to the data electrode S3, and (a) the drive voltage waveform applied to the pixel, the waveform corresponding to the difference (T5–S3) between the drive voltage waveform of the scanning electrode T5 (b4) and the drive voltage waveform of the data electrode S3 (d).

As described above, in the scanning signals shown in FIGS. 14 and 15, the drive voltage is produced with the front-edge drive waveform, and in the scanning signals shown in FIGS. 16 and 17, the drive voltage is produced with the back-edge drive waveform. The drive voltage waveform in the period subsequent to the front-edge drive waveform or back-edge drive waveform also has the shape that offsets the variation of the rms voltage, as shown in the drive voltage waveform (a).

As described above, in the present invention, the front-edge drive waveform and back-edge drive waveform are produced in the above manner, and the pixel drive waveform is switched between these two waveforms alternately for every n horizontal scanning signals, so that the variation of the rms voltage is offset and the effect of the variation is reduced. As a result, crosstalk that would occur with the voltage averaging method, due to the accumulation of deviations from the ideal rms voltage, can be suppressed.

The above embodiments have been described by taking as an example the voltage waveform when the matrix-addressed liquid-crystal panel of FIG. 2 is driven to produce a 16-gray scale display, with the pixel 100 displaying gray scale 12 and the pixel 102 gray scale 4, and when the liquid crystal is driven under the condition in which the majority of pixels in the panel are displaying gray scale 12. It will, however, be appreciated that the present invention is also applicable to liquid crystal driving apparatuses in which spikes are generated and the rms voltage varies under other conditions.

Further, the above embodiments have been described dealing with STN and TN liquid crystals, but the present invention is also applicable when antiferroelectric liquid crystal is used.

What is claimed is:

1. A liquid crystal driving method for a matrix-addressed liquid-crystal panel that displays gray scale using a voltage averaging method, characterized in that a drive waveform in a period that determines the gray scale of liquid crystal display is a front-edge drive waveform having an edge at its front end or a back-edge drive waveform having an edge at its back end, and in that said drive waveform is switched between said front-edge drive waveform and said back-edge drive waveform alternately for every n horizontal scanning signals (where n is a positive integer).

2. A liquid crystal driving method according to claim 1, wherein said front-edge drive waveform and said back-edge drive waveform are produced by adjusting a phase between a scanning electrode drive waveform, which is applied to a scanning electrode in said liquid-crystal panel, and a data electrode drive waveform, which is applied to a data electrode in said liquid-crystal panel, and said drive waveform is switched between said front-edge drive waveform and said back-edge drive waveform alternately for every n horizontal scanning signals (where n is a positive integer).

3. A liquid crystal driving method according to claim 1, wherein said front-edge drive waveform and said back-edge drive waveform are produced by changing a shape of a data electrode drive waveform that is applied to a data electrode in said liquid-crystal panel, and said drive waveform is switched between said front-edge drive waveform and said back-edge drive waveform alternately for every n horizontal scanning signals (where n is a positive integer).

4. A liquid crystal driving method according to claim 1, wherein said front-edge drive waveform and said back-edge drive waveform are produced by adjusting a phase between a scanning electrode drive waveform, which is applied to a scanning electrode in said liquid-crystal panel, and a data electrode drive waveform, which is applied to a data electrode in said liquid-crystal panel, and by changing the shape of said data electrode drive waveform that is applied to said data electrode in said liquid-crystal panel, and said drive waveform is switched between said front-edge drive waveform and said back-edge drive waveform alternately for every n horizontal scanning signals (where n is a positive integer).

5. A liquid-crystal display apparatus employing a liquid crystal driving method for a matrix-addressed liquid-crystal panel that displays gray scale using a voltage averaging method, characterized in that a drive waveform in a period that determines the gray scale of liquid crystal display is a front-edge drive waveform having an edge at its front end or a back-edge drive waveform having an edge at its back end, and in that said drive waveform is switched between said front-edge drive waveform and said back-edge drive waveform alternately for every n horizontal scanning signals (where n is a positive integer).

6. A liquid-crystal display apparatus according to claim 5, wherein said front-edge drive waveform and said back-edge drive waveform are produced by adjusting a phase between a scanning electrode drive waveform, which is applied to a scanning electrode in said liquid-crystal panel, and a data electrode drive waveform, which is applied to a data electrode in said liquid-crystal panel, and said drive waveform is switched between said front-edge drive waveform and said back-edge drive waveform alternately for every n horizontal scanning signals (where n is a positive integer).

7. A liquid-crystal display apparatus according to claim 5, wherein said front-edge drive waveform and said back-edge drive waveform are produced by changing a shape of a data electrode drive waveform that is applied to a data electrode in said liquid-crystal panel, and said drive waveform is switched between said front-edge drive waveform and said back-edge drive waveform alternately for every n horizontal scanning signals (where n is a positive integer).

8. A liquid-crystal display apparatus according to claim 5, wherein said front-edge drive waveform and said back-edge drive waveform are produced by adjusting a phase between a scanning electrode drive waveform, which is applied to a scanning electrode in said liquid-crystal panel, and a data electrode drive waveform, which is applied to a data electrode in said liquid-crystal panel, and by changing a shape of said data electrode drive waveform that is applied to said data electrode in said liquid-crystal panel, and said drive waveform is switched between said front-edge drive waveform and said back-edge drive waveform alternately for every n horizontal scanning signals (where n is a positive integer).

* * * * *